US005515549A

United States Patent [19]

Wang

[11] Patent Number: 5,515,549

[45] Date of Patent: May 14, 1996

[54] PATIENT CARRYING DEVICE

[76] Inventor: Ge Wang, 18689 Bellorita St., Rowland Heights, Calif. 91748

[21] Appl. No.: 389,933

[22] Filed: Feb. 17, 1995

[51] Int. Cl.[6] ..... A61G 1/013; A61G 1/044; A61G 1/048

[52] U.S. Cl. ..... 5/625; 5/627; 297/183.6

[58] Field of Search ..... 5/625, 627, 628, 5/81.1, 89.1; 224/159, 157, 158; 297/183.6

[56] References Cited

U.S. PATENT DOCUMENTS

| | | | |
|---|---|---|---|
| 1,849,864 | 3/1932 | Caspar | 5/625 |
| 2,835,902 | 5/1958 | Fash | 5/627 |
| 3,271,796 | 9/1966 | Dillman | 5/625 |
| 4,782,539 | 11/1988 | Elliott | 224/159 |
| 5,056,533 | 10/1991 | Solano | 5/627 |
| 5,161,275 | 11/1992 | Simpson et al. | 5/625 |

FOREIGN PATENT DOCUMENTS

| | | | |
|---|---|---|---|
| 468336 | 7/1937 | United Kingdom | 5/625 |
| 2213735 | 8/1989 | United Kingdom | 5/627 |

*Primary Examiner*—Alexander Grosz
*Attorney, Agent, or Firm*—Klima & Hopkins

[57] ABSTRACT

A patient carrying device comprising a seat panel connected to a back panel. The seat panel and back panel are preferably made of soft pliable fabric, and hingedly connected together to form a two-dimensional sling like patient carrying device.

13 Claims, 3 Drawing Sheets

FIG. 1
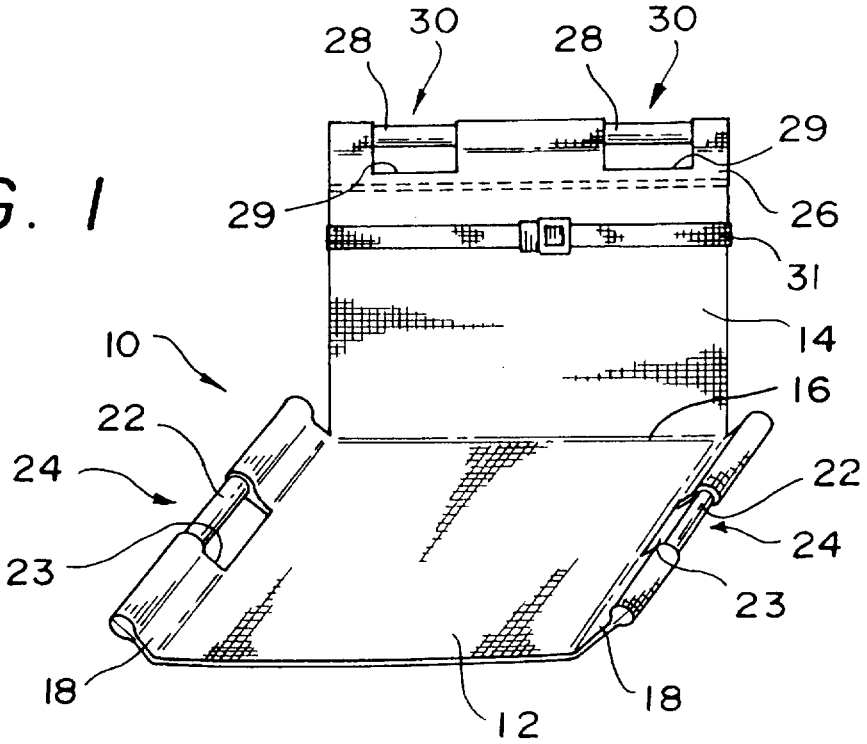
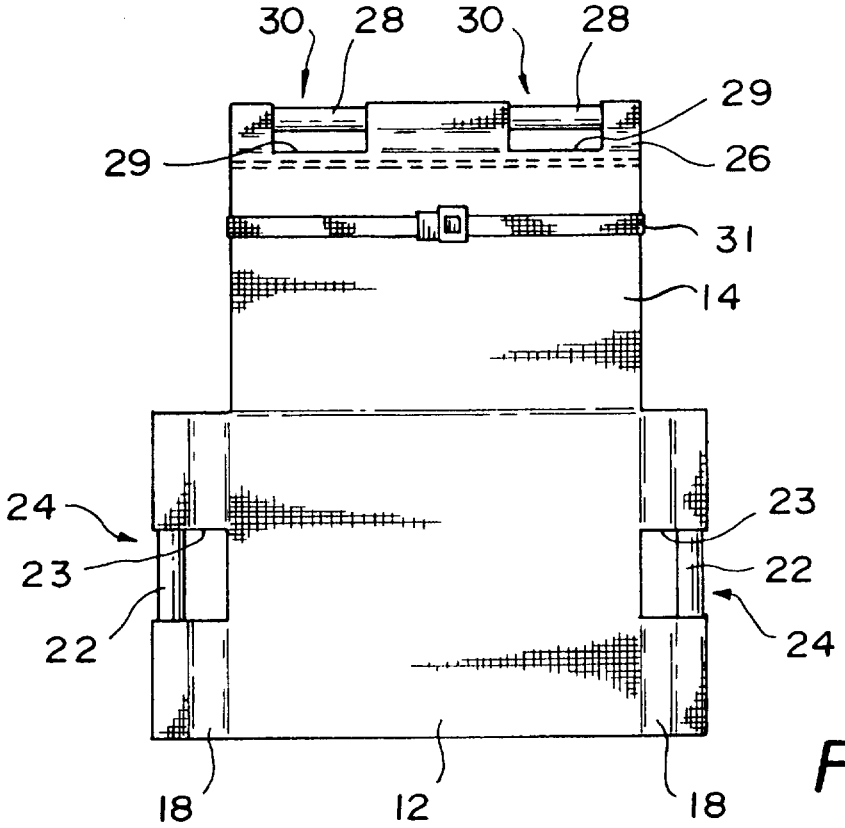
FIG. 2

FIG. 3
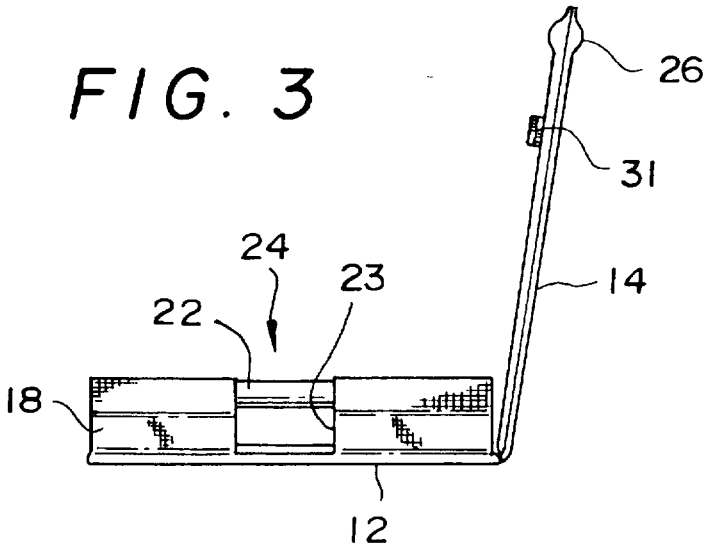
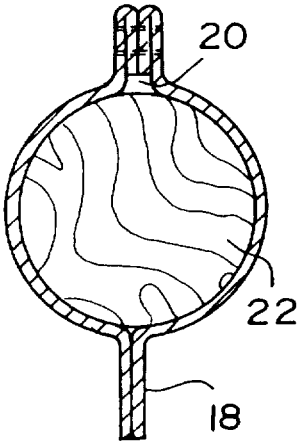
FIG. 5
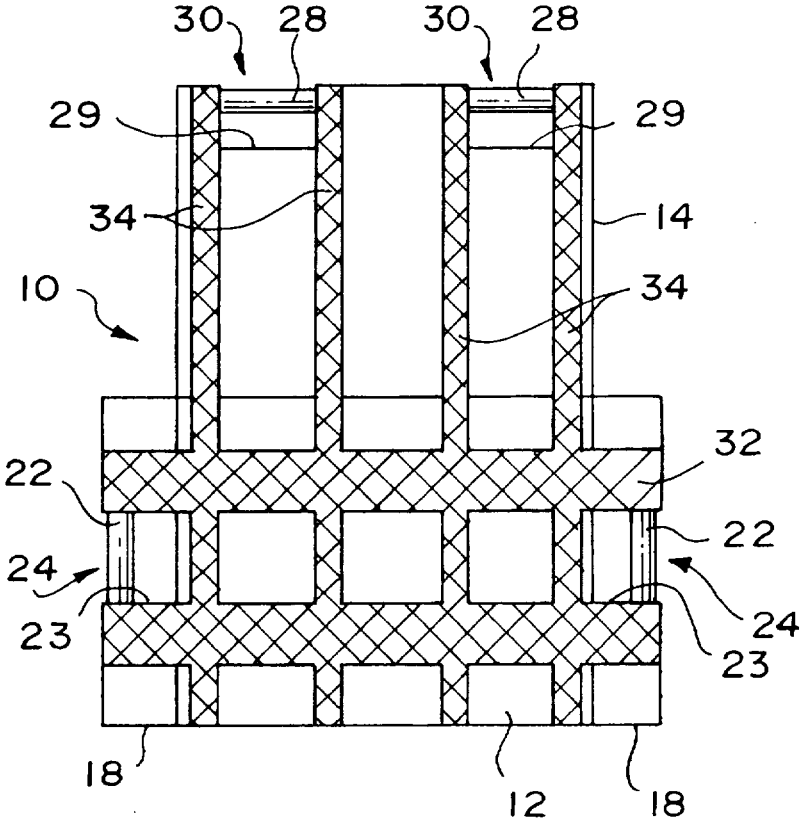
FIG. 4

PATIENT CARRYING DEVICE

FIELD OF THE INVENTION

This invention relates to a device for carrying a patient. Specifically, this invention relates to a patient carrying device having a chair type configuration that can be lifted by two persons positioned on the sides of the device.

BACKGROUND OF THE INVENTION

The use of stretchers is wide spread in the medical emergency field. Stretchers are useful for transporting a person is a fully laid out position during a medical emergency, in particular when the patient is fully disabled and unable to sit up due to injuries, disease or other disabling conditions. A stretcher is easy to handle in a wide open area, however, in a confined area such as a hallway or small room, a stretcher may be difficult to maneuver.

Further, wheel chairs have wide spread applications for transporting patients. Wheel chairs are also commonly used by semi-disabled persons to allow them to move around on their own. A wheel chair is fairly maneuverable in confined areas, however, a wheel chair cannot be used on stairs, or for lifting or lowering a patient to assist a patient into or out of a bed, chair, or other common horizontal support.

All of these conventional patient transporting device suffer in various ways with respect to maneuverability, and tend to be large is size, heavy in weight, complicated in construction, and expensive. There exists a need for a device that allows for a patient to be easily lifted and/or carried short distances or from horizontal support to support for patient handling purposes.

SUMMARY OF THE INVENTION

A first object of the present invention is to provide an improved patient carrying device.

A second object of the present invention is to provide a patient carrying device having a chair type configuration.

A third object of the present invention is to provide a portable patient carrying device.

A fourth object of the present invention is to provide an inexpensive, light weight patient carrying device.

A fifth object of the present invention is to provide a foldable patient carrying device for purposes of storage and for different modes of use.

A sixth object of the present invention is to provide a patient carrying device providing a carrying sling type arrangement to enhance lifting and carrying stability, and holding the patient in a secure manner to prevent falling or sliding from the patient carrying device.

A seventh object of the present invention is to provide a patient carrying device having a two-dimensional carrying sling type arrangement to further enhance lifting and carrying stability, and holding the patient in a secure manner to prevent falling or sliding from the patient carrying device.

These and other objects can be achieved by the patient carrying device according to the present invention. Specifically, the patient carrying device according to the present invention can be use for lifting and/or transporting a patient. The patient carrying device according to the present invention is preferably maintained in a chair type configuration when carrying the patient, however, the device can be folded for the purpose of compactly storing the device or open to function as a mini stretcher.

The device is preferably made of soft pliable fabric seat and back panels hingedly connected together. The seat panel is provided with side panels each having a reinforcing support, and the back panel is provided with a top panel having a reinforcing support. In this arrangement, both the seat panel and back panel perform like slings providing a comfortable and stable carrying configuration when a patient is positioned on the device. Alternatively, the seat panel and back panel can be made more rigid, however, the device will not be as comfortable or stable to use.

The sling type effect of the seat panel is enhanced by providing vertical side panels hingedly connected to the seat panel. This arrangement lowers the center of gravity of the patient sitting in the device relative to the gripping positions on the side panels, again enhancing the overall carrying stability of the device. Further, this arrangement tends to grip the rear end of the patient due to the seat panel conforming to the shape of the patient's rear end being forced inwardly, preventing the patient from inadvertently falling out of the device or slipping from the device when being carded.

The flexible nature of the back panel also acts like a sling allowing the patient's back to curve and sink into the back panel enhancing the carrying stability of the device while providing adequate support.

The reinforcing supports in the side panels of the seat panel and the top panel of the back panel can be made with wooden dowels, plastic or metal rods or conduit, or some other type of suitable structural frame type support. The reinforcing supports are positioned at the extremities of the device to enhance the stability of the device by having the device act like a two-dimensional sling. Further, the reinforcing supports preferably extend the fully length of the side panels and top panel to enhance the gripping stability and overall carrying strength of the device.

Further, the reinforcing supports are connected to the side panels of the seat panel and the top panel of the back panel in a manner so that the reinforcing supports cannot move relative to the fabric material. For example, the reinforcing supports are fully enclosed or captivated in pockets in the side panels and top panel to prevent relative movement with the fabric material. Further, covering the ends of the reinforcing supports can prevent potential injury to the patient or persons carrying the patient.

The patient carrying device according to the present invention is particularly useful for lifting or lowering a patient. For example, the patient carrying device can be place underneath a patient sitting up in bed, and then used to initially lift up and then lower the patient to a wheel chair positioned adjacent the bed. Further, the patient carrying device according to the present invention is particularly useful for transporting a patient short distances, especially in confined areas, around corners, up and down stairs, up and down escalators, into an elevator, etc.

BRIEF DESCRIPTION OF THE DRAWINGS

FIG. 1 is a perspective view of a preferred embodiment of a patient carrying device according to the present invention.

FIG. 2 is a top planar view of the device shown in FIG. 1 laid flat.

FIG. 3 is a side elevational view of the device shown in FIG. 1.

FIG. 4 is a top view illustrating the location of reinforcing strapping in the patient carrying device shown in FIGS. 1 to 3.

FIG. 5 is a detailed partial cross-sectional view through one of the side panels of the seat panel revealing the pocket and support arrangement for lifting the device.

DETAILED DESCRIPTION OF PREFERRED EMBODIMENTS

Figure 6:
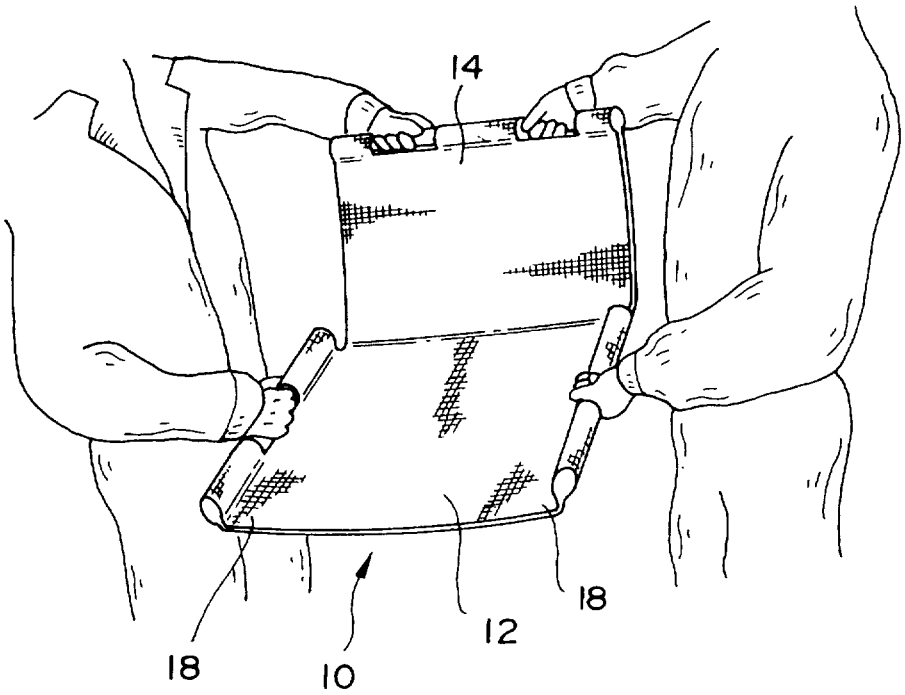
FIG. 6 is a perspective view showing the device held by two persons located on the sides of the device.
Figure 7:
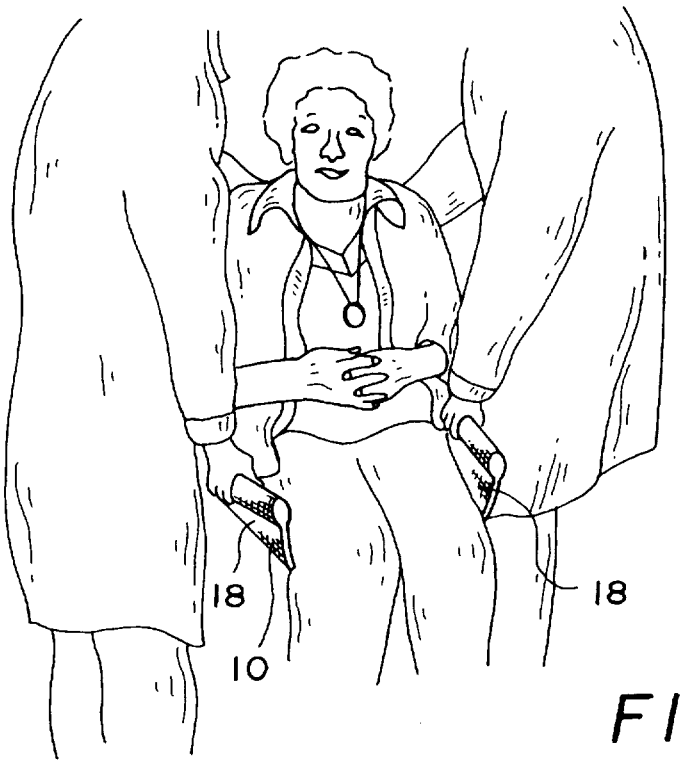
FIG. 7 is perspective view showing a patient being transported by two persons located on the sides of the device.

A preferred embodiment of a patient carrying device 10 according to the present invention is shown in FIGS. 1 to 4.

The patient carrying device comprises a seat panel 12 connected to a back panel 14 in a chair type configuration. Specifically, the seat panel 12 and back panel 14 are preferably soft pliable panels made of fabric material joined together along hinge 16. For example, the seat panel 12 and back panel 14 can be made of the same fabric layer and stitched along the hinge 16 to make the fabric material foldable along the stitched hinge 16, or alteratively, the seat panel 12 and back panel 14 can be made separately and then sewn together along the hinge 16.

The seat panel 12 is provided with a pair of side panels 18 extending along the sides thereof. The side panels 18 are each provided with a pockets 20 (FIG. 5) for accommodating a reinforcing support 22 to allow the patient carrying device 10 to be lifted. Specifically, a portion of each reinforcing support 22 is exposed at the cutouts 23 in the sides panels 18 providing handles 24, which can be gripped by hands for lifting and carrying the patient carrying device 10.

The back panel 14 is provided with a top panel 26 extending along the upper side thereof. The top panel 26 is provided with a pocket (not shown, but having the same arrangement as FIG. 5) for accommodating a reinforcing support 28 to allow the patient carrying device 10 to be lifted, and for adjusting the orientation of the back panel 14 relative to the seat panel 12 when a patient is sitting in the patient lifting device 10 (e.g. to maintain the patient lifting device in a L-shaped chair type configuration). Specifically, portions of the reinforcing support 28 are exposed at cutouts 29 along the back panel 14 providing handles 30 for gripping the patient carrying device 10. Optionally, the back panel 14 can be provided with a seat belt 31 for securing the upper torso of the patient to the back panel 14 during use.

The side panels 18 of the seat panel 12 and the top panel 26 of the back panel 14 can be constructed of the same fabric material as the seat panel 12 and back panel 26. The pockets for accommodating the supports 22 and 28 are made by folding over the fabric material around the reinforcing supports 22 and 28, and then stitching together the folded over portions to the main portion of the fabric material forming the respective pockets. The pockets are preferable made so the supports 22 and 28 are fully enclosed or captivated with the ends thereof enclosed inside the pockets to prevent the supports 22 and 28 from moving during use, and to prevent injury from ends of the supports 22 and 28 being exposed. For example, the supports 22 and 28 can be made of wooden dowels, plastic rods, steels rods, and other structural frame members having a cross-sectional size and design to provide sufficient structural strength to withstand lifting the patient carrying device 10 with a patient load thereon. The ends of the wooden dowels could potentially cause injury to a patient or person lifting the patient if the ends were not fully enclosed in the pockets.

The patient carrying device 10 is preferably made of multiple layers of cotton canvas material making the patient lifting device 10 comfortable, light weight, and easy to clean. The patient carry device 10 is provided with reinforcing strapping 32 in the arrangement shown in FIG. 4. The reinforcing strapping 32 comprises four (4) individual vertical reinforcing straps 34 and two (2) wider horizontal reinforcing straps 36. The width of the straps 34 and 36 are selected to accommodate the load of the patient sitting on the device 10 when being transported. The number, orientation, and widths of the straps can vary in different embodiments, however, the strap arrangement shown is a preferred arrangement.

The reinforcing strapping 32 is located between two (2) layers of outer canvas material. The individual reinforcing straps 34 and 36 are sewn along their lengths between the two (2) layers of outer canvas material to form an integral unit. Further, the individual reinforcing straps 34 are located on either side of the cutouts 29, and the individual reinforcing straps 32 are located on either side of the cutouts 23 to reinforce the edges of the cutouts to prevent tearing of the edges during use.

OPERATION

The patient carrying device 10 is used by placing the device underneath a sitting patient. For example, the patient carrying device 10 can be placed behind the sitting patient, and then the seat panel is slid underneath the rear end of the patient when tilting the patient forward to slightly lift the patient off his or her seat. When the patient is properly seated on the seat panel 12, the back panel is moved in close proximity to the back of the patient, and then the seat belt 31 is placed around the chest of the patient.

Two persons then position themselves on either side of the patient. These persons each grip one handle 24 and one handle 30. Specifically, the person on the left side of the patient uses his or her left hand to grip the handle 24 and his or her fight hand to grip the handle 30. The person on the right side of the patient uses his or her right hand to grip the handle 24 and his or her right hand to grip the handle 30. The two persons then lift the patient by pulling upwardly with both hands simultaneously while balancing the patient. The patient can be placed in a fully sitting position by the two persons adjusting the distance between their respective hands, however, the device is configured so that the hand naturally are set apart when the patient is sitting in a stable position.

Alternatively, the patient carrying device can be placed on a horizontal support such as a bed, chair, or wheelchair, for example, and then the patient can be seated on the device. The patient can then be lifted from the horizontal support for carrying the patient to another location.

As an example of this use, the patient carrying device is positioned in an L-shape configuration in the seat of a wheelchair. Then the patient is lifted under his or her arms from a bed and seated on the wheelchair. The patient then wheels himself or herself to the dining room, and then two aids lift the patient using the patient carrying device from the wheelchair to a conventional chair at the diner table to free up the wheelchair for further immediate use. This is just one scenario of many that can occur in a hospital or elderly retirement home.

I claim:

1. A patient carrying device for lifting and carrying a patient, said device comprising:

a horizontal seat panel made of soft pliable fabric material;

a pair of vertical side panels hindgedly connected to respective sides of said seat panel, said side panels having reinforcing supports accessible through cutouts in said side panels defining handles in said side panels a back panel made of soft pliable fabric material, said back panel hingedly connected to said seat panel;

a top panel connected to a top portion of said back panel, said top panel having a reinforcing support accessible through two cutouts in said top panel defining handles in said top panel; and reinforcing strapping connected to said seat panel and said back panel, said reinforcing strapping comprising individual vertical straps located on either side of each cutout and extending a substantial portion of the height of said top panel, and individual horizontal straps located on either side of said cutouts in said side panels and extending a substantial portion of the width of said seat panel.

2. A device according to claim 1, wherein said reinforcing strapping is sewn to said fabric material.

3. A device according to claim 2, wherein each individual vertical and horizontal strap is sewn to said fabric material.

4. A device according to claim 1, wherein said reinforcing supports in said side panels and said top panel are received within pockets made with said fabric material.

5. A device according to claim 4, wherein said reinforcing supports are fully captivated by said pockets so that said reinforcing supports cannot move relative to said fabric material, and so that ends of said reinforcing supports are not exposed to prevent injury to the patient or persons carrying the patient during use of the device.

6. A device according to claim 1, wherein said reinforcing supports are wooden dowels.

7. A device according to claim 1, wherein said device includes a seat belt.

8. A device according to claim 7, wherein said seat belt is connected to said back panel.

9. A device according to claim 1, wherein said reinforcing supports extend the full length of said side panels and said top panels.

10. A device according to claim 1, wherein said reinforcing supports are connected to said sided panels and said top panel in a manner to prevent movement relative to said fabric material.

11. A device according to claim 1, wherein said reinforcing supports are fully captivated so that ends thereof are not exposed to prevent injury to the patient or persons carrying the patient.

12. A device according to claim 10, wherein said reinforcing supports are fully captivated so that ends thereof are not exposed to prevent injury to the patient or persons carrying the patient.

13. A device according to claim 1, wherein said seat panel and said back panel act as a sling for cradling the patient in a stable manner.

* * * * *